US012146721B2

(12) United States Patent
Williams et al.

(10) Patent No.: US 12,146,721 B2
(45) Date of Patent: Nov. 19, 2024

(54) HYBRID FIREARM MAGAZINE

(71) Applicant: Palmetto State Armory, LLC, Columbia, SC (US)

(72) Inventors: Stephen Williams, Summerville, SC (US); Zach Burris, Summerville, SC (US); Kasimere McManus, Quakertown, PA (US); Matthew Paul Pettit, Jamison, PA (US)

(73) Assignee: Palmetto State Armory, Columbia, SC (US)

( * ) Notice: Subject to any disclaimer, the term of this patent is extended or adjusted under 35 U.S.C. 154(b) by 0 days.

(21) Appl. No.: 17/888,850

(22) Filed: Aug. 16, 2022

(65) Prior Publication Data

US 2023/0235981 A1 Jul. 27, 2023

Related U.S. Application Data

(63) Continuation-in-part of application No. 29/824,623, filed on Jan. 26, 2022, now Pat. No. Des. 1,016,955.

(60) Provisional application No. 63/390,437, filed on Jul. 19, 2022.

(51) Int. Cl.
*F41A 9/71* (2006.01)

(52) U.S. Cl.
CPC ..... *F41A 9/71* (2013.01)

(58) Field of Classification Search
CPC ..... F41A 9/71; F41A 9/61; F41A 9/64; F41A 9/65
See application file for complete search history.

(56) References Cited

U.S. PATENT DOCUMENTS

| | | | | |
|---|---|---|---|---|
| 5,357,703 | A | 10/1994 | Chesnut et al. | |
| 5,438,783 | A | 8/1995 | Sniezak et al. | |
| D748,219 | S | 1/2016 | Kielsmeier et al. | |
| D757,884 | S | 5/2016 | Kielsmeier et al. | |
| D783,111 | S | 4/2017 | Hilis | |
| D810,223 | S | 2/2018 | Kielsmeier et al. | |
| D858,680 | S | 9/2019 | Thomele et al. | |
| D859,571 | S | 9/2019 | Spine | |
| 10,480,880 | B2 | 11/2019 | Thomele et al. | |
| 10,809,027 | B2 * | 10/2020 | Michut | F41A 9/65 |
| D912,190 | S | 3/2021 | Thomele et al. | |
| D912,191 | S | 3/2021 | Thomele et al. | |

(Continued)

FOREIGN PATENT DOCUMENTS

WO WO-2019144160 A1 * 7/2019 ..... B29C 45/14336

OTHER PUBLICATIONS

Palmetto State Armory, PSA Dagger Micro 9MM 15 Round Magazine With Micro Slick® Finish, <https://palmetto state armory.com/psa-dagger-micro-9mm-15-round-slick-magazine.html>, Online, Sep. 30, 2023.

(Continued)

*Primary Examiner* — Jonathan C Weber
(74) *Attorney, Agent, or Firm* — Offit Kurman; Douglas L. Lineberry

(57) ABSTRACT

Described herein are hybrid material firearms magazines that combine a polymer overmold with a metal ammunition magazine to provide a superior magazine capable of holding increased amounts of ammunition while overcoming various problems associated with traditional metal only and/or polymer only magazines as well as methods for making the magazines disclosed herein.

20 Claims, 8 Drawing Sheets

(56) References Cited

U.S. PATENT DOCUMENTS

| | | | | |
|---|---|---|---|---|
| D917,649 | S | 4/2021 | Thomele et al. | |
| D987,010 | S | 5/2023 | Spine et al. | |
| 2008/0190003 | A1 | 8/2008 | Bolen | |
| 2010/0281737 | A1* | 11/2010 | Cahill | F41A 9/70 42/50 |
| 2013/0227870 | A1 | 9/2013 | Rendulic | |
| 2015/0121736 | A1* | 5/2015 | Faifer | F16F 1/021 42/49.01 |
| 2016/0282071 | A1* | 9/2016 | Vilardi | F41A 9/65 |
| 2016/0290750 | A1* | 10/2016 | McCormick | F41A 9/66 |
| 2018/0058784 | A1* | 3/2018 | McCormick | F41A 9/65 |
| 2020/0018563 | A1* | 1/2020 | Michut | F41A 9/70 |
| 2021/0080204 | A1* | 3/2021 | Yeates | B29C 45/14336 |
| 2022/0307784 | A1* | 9/2022 | Lee | F41A 9/62 |

OTHER PUBLICATIONS

SPN Firearms, Did The PSA Micro Dagger Save The Glock 43x Capacity Crisis?, <https://www.youtube.com/watch?v=omZxzY9sbWU>, Online, Publ. Jul. 29, 2023.

Patrick Roberts, Shield Arms Opens Pre-Orders for S15 15-Round Clock 43X/48 Magazines, <https://www.recoilweb.com/shield-arms-opens-pre-orders-for-s15-15-round-glock-43x-48-magazines-152949.html>, Online, Publ. Sep. 16, 2019.

Big Timber Lodge, Glock 43X Upgrade: Shield Arms S15 Gen 2 Magazine, <https://www.youtube.com/watch?v=MWRPxqkPs2E>, Online, Publ. Sep. 8, 2022.

* cited by examiner

HYBRID FIREARM MAGAZINE

TECHNICAL FIELD

The subject matter disclosed herein is generally directed to hybrid material firearms magazines that combine a polymer overmold with a metal ammunition magazine to provide a superior hybrid magazine capable of holding increased amounts of ammunition while overcoming various problems associated with traditional metal only and/or polymer only magazines as well as methods for making the magazines disclosed herein.

BACKGROUND

Current small arms magazines on the market either have polymer exteriors and require a polymer magazine catch or have steel bodies that require a metal magazine catch. Most polymer magazines are limited to a lower round count due to the interior capacity while steel typically allows for a higher round count due to the increased interior capacity. This creates a situation that either a shooter must live with a lower round capacity or purchase a steel magazine along with an additional metal magazine catch to work properly with their steel magazine body. This increases cost but also then limits the shooter from using their Original Equipment Manufacturer polymer magazines with a steel magazine catch. This solution provides the shooter with a higher magazine capacity while still allowing them to use the factory polymer magazine catch and use polymer magazines. Through our geometry and feed angle design we have also eliminated issues with feeding and limited functionality with Slide Stops unlike current metal magazines on the market.

What is needed in the industry is a "best of both worlds" approach providing the benefits of both polymer and steel magazines captured in one magazine. Accordingly, it is an object of the present disclosure to provide a hybrid between all steel and complete polymer overmolded magazines. This magazine utilizes a steel body with a front overmolded polymer section which allows it to accept a higher number of rounds, such as for purposes of example only and not intended to be limiting, accepting fifteen (15) rounds over competitor magazines that only hold ten (10) rounds, yet still utilize a standard polymer magazine catch. The current disclosure allows consumers to purchase a larger capacity magazine without needing to purchase an additional magazine catch to work with their magazine.

Citation or identification of any document in this application is not an admission that such a document is available as prior art to the present disclosure.

SUMMARY

The above objectives are accomplished according to the present disclosure by providing in one instance an overmolded hybrid firearm magazine. The hybrid magazine may include a firearm magazine with a magazine tube formed from at least one metal and at least one overmolded polymer section affixed to the magazine tube; the at least one overmolded polymer section is defined on at least one face of the firearm magazine and at least one face of the firearm magazine lacks the overmolded polymer section, the at least one polymer section extends at least partially over the at least one face of the firearm section containing the at least one overmolded polymer section; and the at least one overmolded section defines at least one non-metallic surface for engaging a magazine catch on a firearm. Further, a distal face of the firearm magazine may contain the at least one overmolded polymer section. Yet still, the at least one overmolded polymer section may be selected from a polymer comprising Polyamide 6 (PA6), Polyamide 6-6 (PA6-6), Polyphenylsulfone (PPSU), Polysulfone (PSU), Polyphthalamide (PPA), Acetal, Polyether ether ketone (PEEK), Polyketone and/or mixtures of the above. Again, the at least one overmolded polymer section may extend from an uppermost section of the magazine tube and terminate adjacent a magazine plate. Even further, the at least one polymer section may extend from a magazine first horizontal plane to a magazine second horizontal plane. Still yet again, the at least one overmolded polymer section extends from the magazine first horizontal plane to the magazine second horizontal plane covering from 30% to 100% of a magazine front face section. Again, at least one hole may be defined in the magazine tube configured to affix the at least one overmolded polymer section to the magazine tube via at least a portion of the at least one overmolded polymer section extending into the magazine tube via the at least one hole. Further still, at least one formed feature may be defined on the magazine tube configured to frictionally engage the at least one overmolded polymer section and affix the at least one overmolded polymer to the magazine tube. Still yet further, the at least one overmolded polymer section may not cover a rear face section of the magazine tube. Even further, the magazine tube may be formed from stainless steel.

In a further embodiment, the current disclosure may provide an overmolded hybrid firearm magazine comprising a firearm magazine with a magazine tube formed from at least one metal and at least one overmolded polymer section affixed to the magazine tube via at least one hole defined in the magazine tube configured to affix the at least one overmolded polymer section to the magazine tube via at least a portion of the at least one overmolded polymer section extending into the magazine tube via the at least one hole, wherein the overmolded polymer section may be defined on a front face section the firearm magazine and a rear face section lacks the overmolded polymer section, the polymer section may extend at least partially over the at least one face of the firearm section containing the at least one overmolded polymer section; and the at least one overmolded section defining at least one non-metallic surface for engaging a polymer catch on a firearm.

In a still further embodiment, a method for making an overmolded hybrid firearm magazine is provided. The method may include forming a firearm magazine having a magazine tube formed from at least one metal; affixing at least one overmolded polymer section affixed to the magazine tube; defining at least one overmolded polymer section on at least one face of the firearm magazine; forming at least one face of the firearm magazine to lack the overmolded polymer section; extending the at least one polymer section at least partially over the at least one face of the firearm section containing the at least one overmolded polymer section; and defining at least one non-metallic surface in the at least one overmolded polymer section and configuring same to engage a magazine catch on a firearm. Further, a distal face of the firearm magazine may be configured to define the at least one overmolded polymer section. Still yet, the at least one overmolded polymer section may be made from a polymer comprising PA6, PA66, PPSU, PSU, PPA, ACETAL, PEEK, Polyketone and/or mixtures of the above. Further still, the at least one overmolded polymer section may extend from an uppermost section of the magazine tube and terminate adjacent a magazine plate. Yet further, the at least one overmolded polymer section may extend from a magazine first horizontal plane to a magazine second horizontal plane. Even further, the at least one overmolded polymer section may extend from the magazine first horizontal plane to the magazine second horizontal plane to cover from 30% to 100% of a magazine front face section in order to at least partially encircle the magazine tube with the overmolded polymer section. Still further yet, at least one hole may be defined in the magazine tube and configured to affix the overmolded polymer section to the magazine tube via at least a portion of the overmolded polymer section extending into the magazine tube via the at least one hole. Still further yet, at least one formed feature may be defined on the magazine tube and configured to frictionally engage the overmolded polymer section and affix the at least one overmolded polymer to the magazine tube. Still again, a rear face section of the magazine tube may be uncovered by the at least one overmolded polymer section. Even further still, the magazine tube may be stainless steel.

These and other aspects, objects, features, and advantages of the example embodiments will become apparent to those having ordinary skill in the art upon consideration of the following detailed description of example embodiments.

BRIEF DESCRIPTION OF THE DRAWINGS

An understanding of the features and advantages of the present disclosure will be obtained by reference to the following detailed description that sets forth illustrative embodiments, in which the principles of the disclosure may be utilized, and the accompanying drawings of which.

Figure 1:
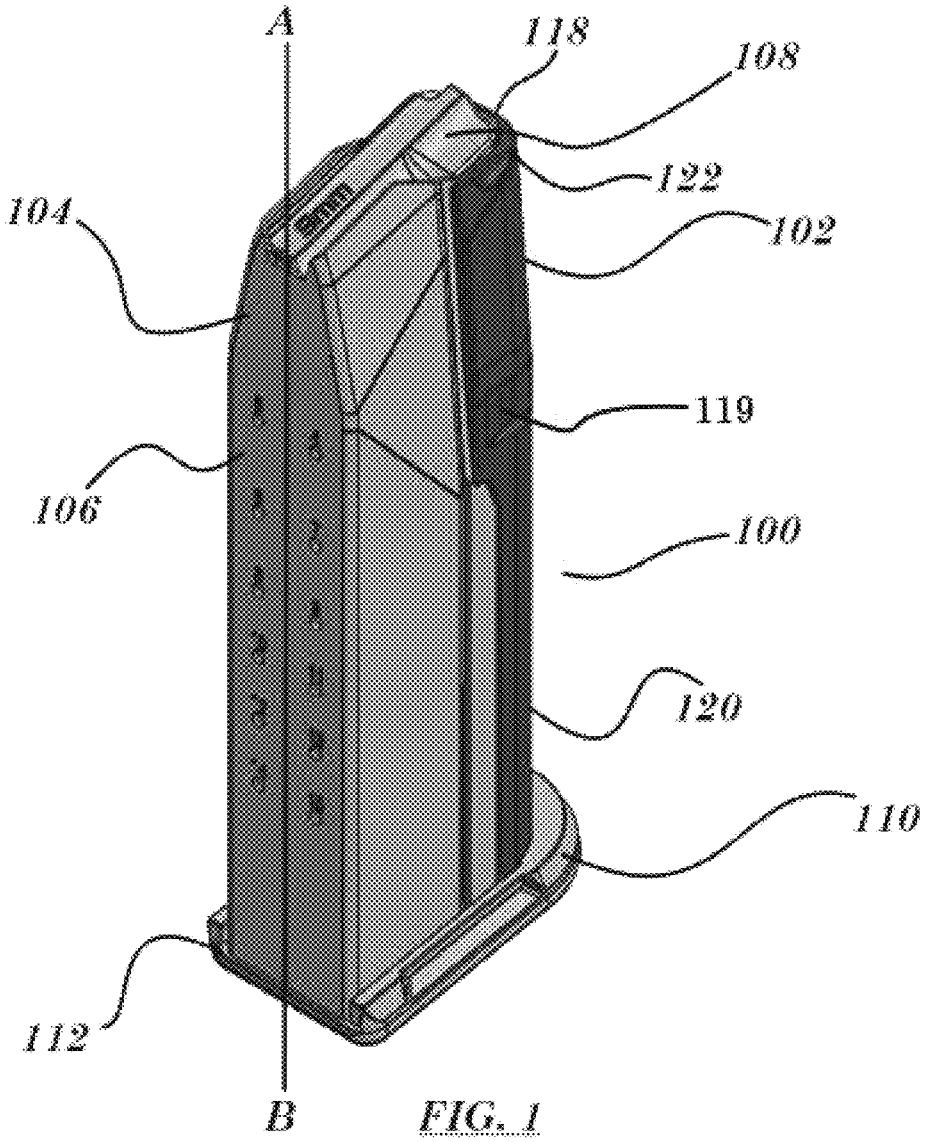
FIG. 1 shows one embodiment of a hybrid magazine as disclosed herein.

The figures herein are for illustrative purposes only and are not necessarily drawn to scale.

DETAILED DESCRIPTION OF THE EXAMPLE EMBODIMENTS

Before the present disclosure is described in greater detail, it is to be understood that this disclosure is not limited to particular embodiments described, and as such may, of course, vary. It is also to be understood that the terminology used herein is for the purpose of describing particular embodiments only, and is not intended to be limiting.

Unless specifically stated, terms and phrases used in this document, and variations thereof, unless otherwise expressly stated, should be construed as open ended as opposed to limiting. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise.

Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, the preferred methods and materials are now described.

All publications and patents cited in this specification are cited to disclose and describe the methods and/or materials in connection with which the publications are cited. All such publications and patents are herein incorporated by references as if each individual publication or patent were specifically and individually indicated to be incorporated by reference. Such incorporation by reference is expressly limited to the methods and/or materials described in the cited publications and patents and does not extend to any lexicographical definitions from the cited publications and patents. Any lexicographical definition in the publications and patents cited that is not also expressly repeated in the instant application should not be treated as such and should not be read as defining any terms appearing in the accompanying claims The citation of any publication is for its disclosure prior to the filing date and should not be construed as an admission that the present disclosure is not entitled to antedate such publication by virtue of prior disclosure. Further, the dates of publication provided could be different from the actual publication dates that may need to be independently confirmed.

As will be apparent to those of skill in the art upon reading this disclosure, each of the individual embodiments described and illustrated herein has discrete components and features which may be readily separated from or combined with the features of any of the other several embodiments without departing from the scope or spirit of the present disclosure. Any recited method can be carried out in the order of events recited or in any other order that is logically possible.

Where a range is expressed, a further embodiment includes from the one particular value and/or to the other particular value. The recitation of numerical ranges by endpoints includes all numbers and fractions subsumed within the respective ranges, as well as the recited endpoints. Where a range of values is provided, it is understood that each intervening value, to the tenth of the unit of the lower limit unless the context clearly dictates otherwise, between the upper and lower limit of that range and any other stated or intervening value in that stated range, is encompassed within the disclosure. The upper and lower limits of these smaller ranges may independently be included in the smaller ranges and are also encompassed within the disclosure, subject to any specifically excluded limit in the stated range. Where the stated range includes one or both of the limits, ranges excluding either or both of those included limits are also included in the disclosure. For example, where the stated range includes one or both of the limits, ranges excluding either or both of those included limits are also included in the disclosure, e.g. the phrase "x to y" includes the range from 'x' to 'y' as well as the range greater than 'x' and less than 'y'. The range can also be expressed as an upper limit, e.g. 'about x, y, z, or less' and should be interpreted to include the specific ranges of 'about x', 'about y', and 'about z' as well as the ranges of 'less than x', 'less than y', and 'less than z'. Likewise, the phrase 'about x, y, z, or greater' should be interpreted to include the specific ranges of 'about x', 'about y', and 'about z' as well as the ranges of 'greater than x', 'greater than y', and 'greater than z'. In addition, the phrase "about 'x' to 'y'", where 'x' and 'y' are numerical values, includes "about 'x' to about 'y'".

It should be noted that ratios, concentrations, amounts, and other numerical data can be expressed herein in a range format. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. Ranges can be expressed herein as from "about" one particular value, and/or to "about" another particular value. Similarly, when values are expressed as approximations, by use of the antecedent "about," it will be understood that the particular value forms a further aspect. For example, if the value "about 10" is disclosed, then "10" is also disclosed.

It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a numerical range of "about 0.1% to 5%" should be interpreted to include not only the explicitly recited values of about 0.1% to about 5%, but also include individual values (e.g., about 1%, about 2%, about 3%, and about 4%) and the sub-ranges (e.g., about 0.5% to about 1.1%; about 5% to about 2.4%; about 0.5% to about 3.2%, and about 0.5% to about 4.4%, and other possible sub-ranges) within the indicated range.

As used herein, the singular forms "a", "an", and "the" include both singular and plural referents unless the context clearly dictates otherwise.

As used herein, "about," "approximately," "substantially," and the like, when used in connection with a measurable variable such as a parameter, an amount, a temporal duration, and the like, are meant to encompass variations of and from the specified value including those within experimental error (which can be determined by e.g. given data set, art accepted standard, and/or with e.g. a given confidence interval (e.g. 90%, 95%, or more confidence interval from the mean), such as variations of +/−10% or less, +/−5% or less, +/−1% or less, and +/−0.1% or less of and from the specified value, insofar such variations are appropriate to perform in the disclosure. As used herein, the terms "about," "approximate," "at or about," and "substantially" can mean that the amount or value in question can be the exact value or a value that provides equivalent results or effects as recited in the claims or taught herein. That is, it is understood that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art such that equivalent results or effects are obtained. In some circumstances, the value that provides equivalent results or effects cannot be reasonably determined. In general, an amount, size, formulation, parameter or other quantity or characteristic is "about," "approximate," or "at or about" whether or not expressly stated to be such. It is understood that where "about," "approximate," or "at or about" is used before a quantitative value, the parameter also includes the specific quantitative value itself, unless specifically stated otherwise.

The term "optional" or "optionally" means that the subsequent described event, circumstance or substituent may or may not occur, and that the description includes instances where the event or circumstance occurs and instances where it does not.

As used herein, "polymer" refers to molecules made up of monomers repeat units linked together. "Polymers" are understood to include, but are not limited to, homopolymers, copolymers, such as for example, block, graft, random and alternating copolymers, terpolymers, etc. and blends and modifications thereof. "A polymer" can be can be a three-dimensional network (e.g. the repeat units are linked together left and right, front and back, up and down), a two-dimensional network (e.g. the repeat units are linked together left, right, up, and down in a sheet form), or a one-dimensional network (e.g. the repeat units are linked left and right to form a chain). "Polymers" can be composed, natural monomers or synthetic monomers and combinations thereof. The polymers can be biologic (e.g. the monomers are biologically important (e.g. an amino acid), natural, or synthetic.

As used interchangeably herein, the terms "sufficient" and "effective," can refer to an amount (e.g. mass, volume, dosage, concentration, and/or time period) needed to achieve one or more desired and/or stated result(s). For example, a therapeutically effective amount refers to an amount needed to achieve one or more therapeutic effects.

As used herein, "tangible medium of expression" refers to a medium that is physically tangible or accessible and is not a mere abstract thought or an unrecorded spoken word. "Tangible medium of expression" includes, but is not limited to, words on a cellulosic or plastic material, or data stored in a suitable computer readable memory form. The data can be stored on a unit device, such as a flash memory or CD-ROM or on a server that can be accessed by a user via, e.g. a web interface.

As used herein, "therapeutic" can refer to treating, healing, and/or ameliorating a disease, disorder, condition, or side effect, or to decreasing in the rate of advancement of a disease, disorder, condition, or side effect. A "therapeutically effective amount" can therefore refer to an amount of a compound that can yield a therapeutic effect.

Various embodiments are described hereinafter. It should be noted that the specific embodiments are not intended as an exhaustive description or as a limitation to the broader aspects discussed herein. One aspect described in conjunction with a particular embodiment is not necessarily limited to that embodiment and can be practiced with any other embodiment(s). Reference throughout this specification to "one embodiment", "an embodiment," "an example embodiment," means that a particular feature, structure or characteristic described in connection with the embodiment is included in at least one embodiment of the present disclosure. Thus, appearances of the phrases "in one embodiment," "in an embodiment," or "an example embodiment" in various places throughout this specification are not necessarily all referring to the same embodiment, but may. Furthermore, the particular features, structures or characteristics may be combined in any suitable manner, as would be apparent to a person skilled in the art from this disclosure, in one or more embodiments. Furthermore, while some embodiments described herein include some but not other features included in other embodiments, combinations of features of different embodiments are meant to be within the scope of the disclosure. For example, in the appended claims, any of the claimed embodiments can be used in any combination.

All patents, patent applications, published applications, and publications, databases, websites and other published materials cited herein are hereby incorporated by reference to the same extent as though each individual publication, published patent document, or patent application was specifically and individually indicated as being incorporated by reference.

Kits

Any of the firearm magazines disclosed herein can be presented as a combination kit. As used herein, the terms "combination kit" or "kit of parts" refers to the magazines and any additional components that are used to package, sell, market, deliver, and/or provide the magazine(s) disclosed herein. Such additional components include, but are not limited to, packaging, blister packages and the like. When one or more of the magazines described herein or a combination thereof (e.g., a firearm, ammunition or firearm component(s) provided with the magazine(s) are provided simultaneously, the combination kit can provide the magazine(s) in combination with the firearm, ammunition, firearm component(s), in a single package/embodiment or separate packages/embodiments. When the magazine(s) described herein or a combination thereof and/or kit components are not provided simultaneously, the combination kit can contain each item or other component in singular or separate combinations. The separate kit components can be contained in a single package or in separate packages within the kit.

In some embodiments, the combination kit also includes instructions printed on or otherwise contained in a tangible medium of expression. The instructions can provide information regarding the magazine(s), safety information, product information regarding the materials used to form the magazine(s) usage instructions, and/or recommended care, usage, handling for the magazine(s) contained therein. In some embodiments, the instructions can provide directions and protocols for using/loading/caring for the magazines and using same with a firearm.

FIG. 1 shows one embodiment of a firearms magazine 100 of the current disclosure. Overmolded polymer section 102, when a magazine of the current disclosure is loaded into a firearm, faces toward the distal, or muzzle end, of the firearm, not shown, while rear face section 104 faces toward the proximal, or butt end, of the firearm, not shown. Overmolded polymer section 102 may be made from the following polymers PA6, PA66, PPSU, PSU, PPA, ACETAL, PEEK, and/or Polyketone, etc. Fillers such as glass fiber, glass beads, talc, etc., may also be used with polymers. Magazine tube 106, may be formed from a metals, for example but not limited to stainless steel, but other steels may be used, but in one embodiment may be a steel material composed of 410 Stainless Steel.

Overmolded polymer section 102 may extend from magazine uppermost portion or top 118 to stop at magazine plate 110. Overmolded section 102 being attached to a metallic magazine tube 106 provides both a polymer and metal hybrid magazine, it also aids in inserting the magazine into a firearm. Overmold section 102 may be shaped and sized to accommodate a variety of shape and size requirements for the magazine to properly function within the firearm. With this specific design, the overmold polymer is required to extend to the magazine plate, but for other design variations that could change and not be required with overmold section 102 extending along only a portion of the front of the magazine and stopping before the magazine plate. In one instance, overmold section 102 functions like a bushing to occupy space while providing a non-metallic engaging surface 119, such as a cleft, declivity or notch, for a polymer catch on a firearm to engage.

Figure 8:
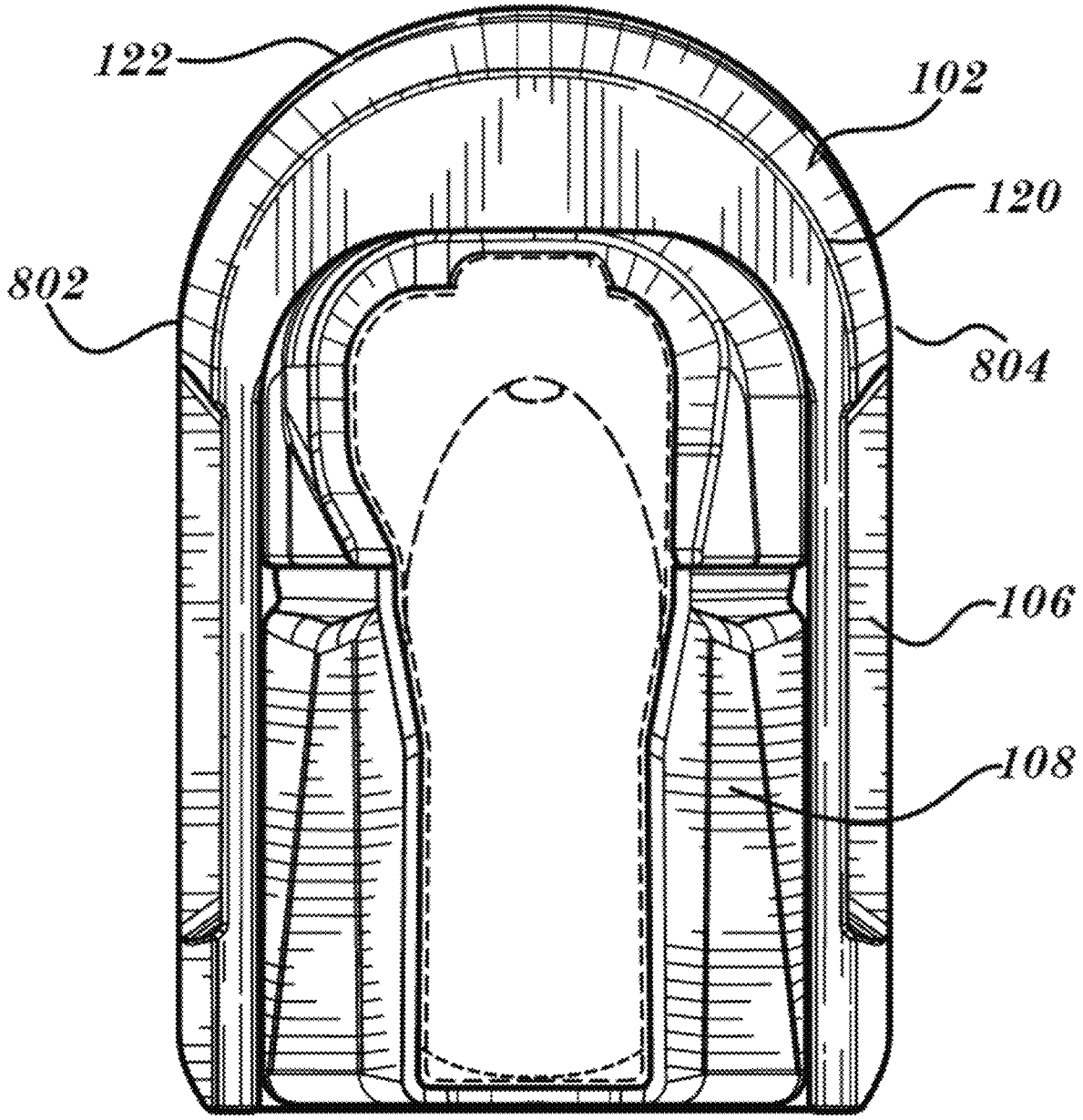
FIG. 8 shows a downward interior view of a hybrid magazine of the current disclosure.

Overmolded polymer section 102 also at least partially encircles and encloses magazine tube 106 magazine front face section 120. See, FIG. 8, a downward looking view into magazine well 106 showing overmolded polymer section 102 covering an entirety or substantially the entirety of magazine front face section 120 from magazine first horizontal plane 802 ("horizontal" refers to the orientation of magazine tube 106 standing upright or as loaded into a firearm and beginning where magazine front arc 122 transforms from an arcuate or curved shape to a substantially straight, linear shape, as denoted at 802 and 804 on FIG. 8) to magazine second horizontal plane 804 to cover all or substantially all of magazine front face section 120. While FIG. 8 shows the entirety of magazine front face section 120 covered, the current disclosure is not so limited and variations of coverage between magazine first horizontal plane 802 and magazine second horizontal plane 804 are included herein such as from 30 to 100%, 35 to 95%, 40 to 90%, 45 to 85%, 50 to 80%, 55 to 75%, 60 to 70%, etc. Coverage may vary based on the firearm design, such as at least up to 50%.

Magazine 100 may also include a magazine follower 108, which urges bullets upward and outward from magazine tube 106 into the firing chamber of the firearm into which magazine 100 is inserted, not shown. Magazine 100 may also include magazine plate 110 and magazine retainer 112. The purpose of magazine plate 110 plate and magazine retainer 112 are to lock the magazine spring within the magazine body preventing it from escaping the magazine body along with allowing the spring to apply upward pressure on the rounds in the magazine, which is crucial in the function of feeding the firearm.

Figure 2:
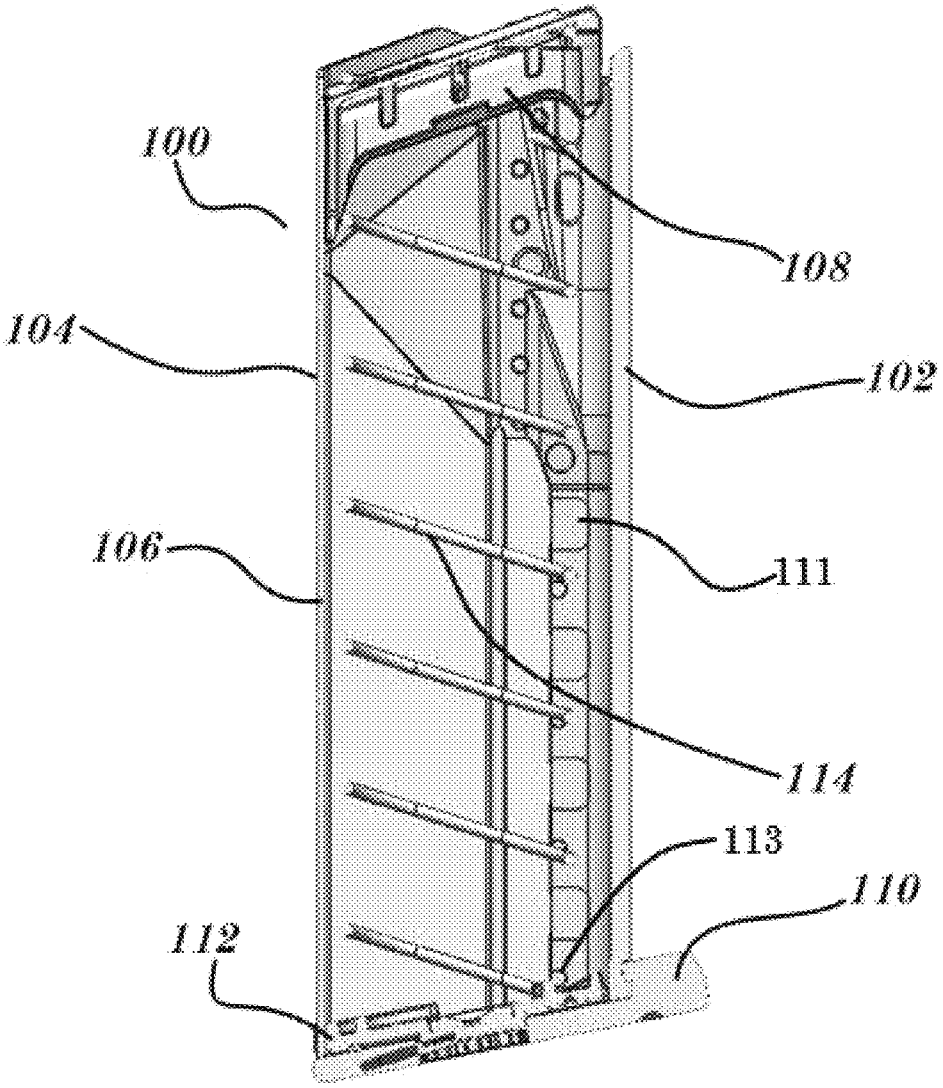
FIG. 2 shows a bisected view of FIG. 1 along line A-B.

FIG. 2 shows a bisected view of magazine 100 taken along line A-B of magazine 100 and shows spring 114 inside magazine interior 116 of magazine tube 106 with magazine follower 108 disposed in its uppermost vertical position as no ammunition is present within firearm magazine 100 to depress spring 114.

Figure 3:
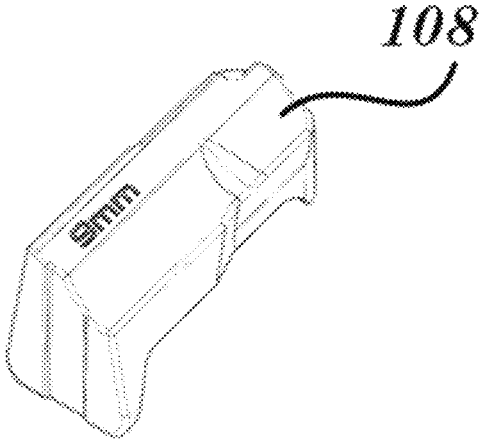
FIG. 3 shows one embodiment of a magazine follower that may be used with hybrid magazines of the current disclosure.

FIG. 3 shows magazine follower 108 removed from magazine tube 106. Magazine follower 108 may be a polymer component produced using a plastic injection molding process. Injection molding is a manufacturing process for producing parts by injecting molten material into a mold. Injection molding can be performed with a host of materials mainly including metals (for which the process is called die-casting), glasses, elastomers, confections, and most commonly thermoplastic and thermosetting polymers. Material for the part is fed into a heated barrel, mixed (using a helical screw), and injected into a mold cavity, where it cools and hardens to the configuration of the cavity. After a product is designed, usually by an industrial designer or an engineer, molds are made by a mold-maker (or toolmaker) from metal, usually either steel or aluminum, and precision-machined to form the features of the desired part. Injection molding is widely used for manufacturing a variety of parts, from the smallest components to entire body panels of cars. Advances in 3D printing technology, using photopolymers that do not melt during the injection molding of some lower-temperature thermoplastics, can be used for some simple injection molds.

Injection molding uses a special-purpose machine that has three parts: the injection unit, the mold and the clamp. Parts to be injection-molded must be very carefully designed to facilitate the molding process; the material used for the part, the desired shape and features of the part, the material of the mold, and the properties of the molding machine must all be taken into account. The versatility of injection molding is facilitated by this breadth of design considerations and possibilities.

Figure 4:
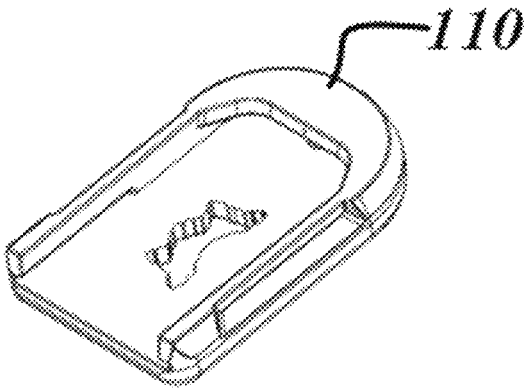
FIG. 4 shows one embodiment of a magazine plate that may be used with hybrid magazines of the current disclosure.

FIG. 4 shows magazine plate 110 removed from magazine tube 106. Magazine plate 110 may be a polymer component produced using a plastic injection molding process.

Figure 5:
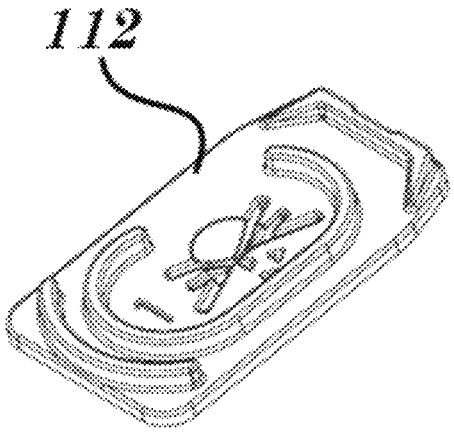
FIG. 5 shows one embodiment of a magazine retainer that may be used with hybrid magazines of the current disclosure.
Figure 6:
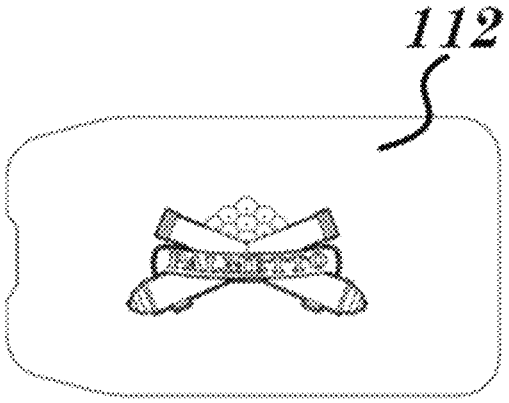
FIG. 6 shows an underside view of a magazine retainer of FIG. 5.

FIG. 5 shows magazine retainer 112 removed from magazine tube 106. Magazine retainer 112 may be a polymer component produced using a Plastic Injection Molding process. FIG. 6 shows a bottom view of magazine retainer 112.

Figure 7:
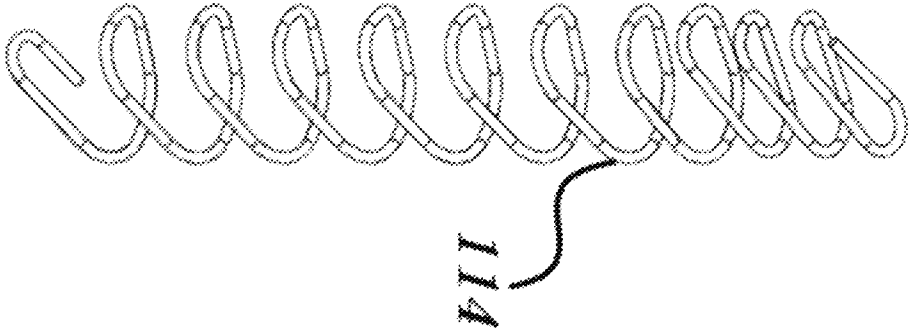
FIG. 7 shows one embodiment of a spring that may be used with a magazine of the current disclosure.

FIG. 7 shows spring 114 removed from magazine tube 106. Spring 114 may be a metal or steel component produced in a spring forming process similar to a coil spring process that involves using machinery to create springs by coiling, winding, or bending the spring wire into the specific designed form.

Magazines of the current disclosure can be made using multiple manufacturing methods. For instance, magazine tube 106 may be a metal material, such as steel, produced using a progressive die stamping process and a plastic injection molding process known as overmolding. Progressive die stamping is a process that involves feeding a coil of metal through a stamping press that simultaneously punches, bends, and shapes the part. The work piece remains attached to the main material from beginning to end and is separated from the base material after the final operation. Plastic injection molding, see supra, involves melting plastic material such as polymer at a temperature it will flow and injecting it into a mold tool that has been designed to mimic the part to be created.

In one embodiment, overmolded polymer section 102 may be formed by taking a finished metal or steel stamped magazine tube 106 and inserting it into a plastic mold tool where molten polymer material is injected into the tool to create an outer shell made of polymer on the Magazine Tube. The Tube has formed features 111, such as gaps, prongs, protrusions, indentions, etc., to frictionally engage the polymer being applied to the magazine tube and holes 113, see FIG. 2, that allow the polymer material to interlock with the Tube to keep the polymer from being able to be easily removed. An Injection Molded Tool may be employed that allows a separate component to be placed within it and then plastic is molded or overmolded to that component. Thril USA is the Manufacturer of one suitable Injection Mold Tool.

The Magazine Tube may be formed using a Progressive Die/Form process that folds and bends the body into the proper shape, creates interlocking holes 113 for the polymer to lock into, and holes that are used as a visual indicator for round count in the magazine. Once it has been formed the seam on the rear of the body is welded and ground to be smooth. Numbers are engraved above each of the round count holes on the back of the magazine. Once completed the part is heat treated then a Marsam Marlube protective finish is applied (Other finishes such as Black Oxide, or Manganese Phosphate may be applied depending on future requirements). The finished Magazine Tube is then inserted into the Injection Mold Tool and molten polymer material is injected into the tool which has been machined to mimic the required polymer shape. The now molded Magazine body is removed from the mold and then cooled.

In one embodiment, to assemble firearm magazine 100 of the current disclosure, one completes the following steps:

STEP 1: Insert Magazine Follower into the Magazine Tube followed by the Magazine Spring and Magazine Retainer.

STEP 2: While depressing the Magazine Spring into the Magazine Tube by pushing on the Retainer slide the Magazine Plate onto the Front of the Magazine Tube and press it completely to the rear.

As cartridges (rounds) are loaded into magazine 100 with the bullet facing toward the distal end of the firearm, magazine follower 108 depresses spring 114 until the desired number of rounds are loaded into magazine 100 or until the maximum holding capacity for magazine 100 is achieved. Magazine follower 108 and spring 114 apply constant pressure on the rounds in an upward direction toward top of magazine 118 so the top round may be picked up and loaded by the firearm's action.

Magazines formed by the current process may have varying capacities and the current disclosure should not be limited to a single capacity. For instance, magazines holding 5, 6, 7, 10, 15, 17, 20 or more, or less than five, rounds are considered disclosed herein as well as amounts between these stated amounts. Further, magazine for all calibers heretofore existing are also considered disclosed herein and the current disclosure should not be considered limited to a single caliber. Further, magazines disclosed herein are not limited to small arms platforms such as .22 cal., 9 mm or 45 mm and can be used on rifle platforms as well as military platforms.

Magazines that may be incorporated with, and modified by, the current disclosure included but are not limited to magazines provided by Thril USA, info@thrilusa.com, established in 2017 with the intent to develop products for the tactical, hunting and recreational outdoor enthusiast provides—THRiL (Tactical, Hunting, Recreation, Loyalty).

Until the present disclosure, industry and manufacturing professionals were of the collective mind that a hybrid style magazine could not be accomplished. A partial over-molded magazine had never been done. Persisting that this was achievable, the inventors and PSA proved it possible, disproving the naysayers and providing the best utility and function for the consumer. A full front polymer with a full rear metal magazine body realizes the best of both worlds for the firearms enthusiast.

Various modifications and variations of the described magazine(s) kits of the disclosure will be apparent to those skilled in the art without departing from the scope and spirit of the disclosure. Although the disclosure has been described in connection with specific embodiments, it will be understood that it is capable of further modifications and that the disclosure as claimed should not be unduly limited to such specific embodiments. Indeed, various modifications of the described modes for carrying out the disclosure that are obvious to those skilled in the art are intended to be within the scope of the disclosure. This application is intended to cover any variations, uses, or adaptations of the disclosure following, in general, the principles of the disclosure and including such departures from the present disclosure come within known customary practice within the art to which the disclosure pertains and may be applied to the essential features herein before set forth.

What is claimed is:

1. An overmolded hybrid firearm magazine comprising:

a firearm magazine having a magazine tube formed from at least one metal with at least one overmolded polymer section affixed to the magazine tube;

the firearm magazine wherein the at least one overmolded polymer section is defined on at least one face of the firearm magazine and at least one face of the firearm magazine lacks the overmolded polymer section;

the at least one polymer section extending at least partially over the at least one face of the firearm section containing the at least one overmolded polymer section wherein the at least one polymer section forms an arc shape that straightens on each side of the magazine tube and abuts at least one distal edge of the magazine tube on each side of the magazine tube; and the at least one overmolded section defining at least one non-metallic surface for engaging a magazine catch on a firearm, wherein the at least one non-metallic surface is not defined in the at least one metal of the magazine tube and only defined by the at least one overmolded section.

2. The overmolded hybrid firearm magazine of claim 1, wherein a distal face of the firearm magazine defines the at least one overmolded polymer section.

3. The overmolded hybrid firearm magazine of claim 1, wherein the at least one overmolded polymer section is selected from a polymer comprising Polyamide 6 (PA6), Polyamide 6-6 (PA6-6), Polyphenylsulfone (PPSU), Polysulfone (PSU), Polyphthalamide (PPA), Acetal, Polyether ether ketone (PEEK), Polyketone and/or mixtures of the above.

4. The overmolded hybrid firearm magazine of claim 1, wherein the at least one overmolded polymer section extends from an uppermost section of the magazine tube and terminates adjacent a magazine plate.

5. The overmolded hybrid firearm magazine of claim 1, wherein the at least one polymer section extends from a magazine first horizontal plane to a magazine second horizontal plane.

6. The overmolded hybrid firearm magazine of claim 5, wherein the at least one overmolded polymer section extends from the magazine first horizontal plane to the magazine second horizontal plane covering from 30% to 100% of a magazine front face section.

7. The overmolded hybrid firearm magazine of claim 1, wherein at least one hole is defined in the magazine tube configured to affix the at least one overmolded polymer section to the magazine tube via at least a portion of the at least one overmolded polymer section extending into the magazine tube via the at least one hole.

8. The overmolded hybrid firearm magazine of claim 1, wherein at least one formed feature is defined on the magazine tube configured to frictionally engage the at least one overmolded polymer section and affix the at least one overmolded polymer to the magazine tube.

9. The overmolded hybrid firearm magazine of claim 1, wherein the at least one overmolded polymer section does not cover a rear face section of the magazine tube.

10. An overmolded hybrid firearm magazine comprising:

a firearm magazine having a magazine tube formed from at least one metal with at least one overmolded polymer section affixed to the magazine tube via at least one hole defined in the magazine tube configured to affix the at least one overmolded polymer section to the magazine tube via at least a portion of the at least one overmolded polymer section extending into the magazine tube via the at least one hole;

the firearm magazine wherein the at least one overmolded polymer section is defined on a front face section the firearm magazine and a rear face section lacks the overmolded polymer section;

the at least one polymer section extending at least partially over the at least one face of the firearm section containing the at least one overmolded polymer section wherein the at least one polymer section forms an arc shape that straightens on each side of the magazine tube and abuts at least one distal edge of the magazine tube on each side of the magazine tube; and the at least one overmolded section defining at least one non-metallic surface for engaging a polymer catch on a firearm wherein the at least one non-metallic surface is not defined in the at least one metal of the magazine tube and only defined by the at least one overmolded section.

11. A method for making an overmolded hybrid firearm magazine comprising:

forming a firearm magazine having a magazine tube formed from at least one metal;

affixing at least one overmolded polymer section affixed to the magazine tube;

defining at least one overmolded polymer section on at least one face of the firearm magazine;

forming at least one face of the firearm magazine to lack the overmolded polymer section;

extending the at least one polymer section at least partially over the at least one face of the firearm section containing the at least one overmolded polymer section wherein the at least one polymer section is formed into an arc shape that straightens on each side of the magazine tube and abuts at least one distal face of the magazine tube on each side of the magazine tube; and defining at least one non-metallic surface in the at least one overmolded polymer section and configuring same to engage a magazine catch on a firearm wherein the at least one non-metallic surface is not defined in the at least one metal of the magazine tube and only defined by the at least one overmolded section.

12. The method of claim 11 further comprising, configuring a distal face of the firearm magazine to define the at least one overmolded polymer section.

13. The method of claim 11 further comprising, selecting the at least one overmolded polymer section from a polymer comprising Polyamide 6 (PA6), Polyamide 6-6 (PA6-6), Polyphenylsulfone (PPSU), Polysulfone (PSU), Polyphthalamide (PPA), Acetal, Polyether ether ketone (PEEK) Polyketone and/or mixtures of the above.

14. The method of claim 11 further comprising, extending the at least one overmolded polymer section from an uppermost section of the magazine tube and terminating the at least one overmolded polymer section adjacent a magazine plate.

15. The method of claim 11 further comprising, extending the at least one overmolded polymer section from a magazine first horizontal plane to a magazine second horizontal plane.

16. The method of claim 15 further comprising, extending the at least one overmolded polymer section from the magazine first horizontal plane to the magazine second horizontal plane to cover from 30% to 100% of a magazine front face section in order to at least partially encircle the magazine tube with the at least one overmolded polymer section.

17. The method of claim 11 further comprising, defining at least one hole in the magazine tube and configuring the at least one hole to affix the at least one overmolded polymer section to the magazine tube via at least a portion of the at least one overmolded polymer section extending into the magazine tube via the at least one hole.

18. The method of claim 11 further comprising, defining at least one formed feature on the magazine tube and configuring the at least one formed feature to frictionally engage the at least one overmolded polymer section and affix the at least one overmolded polymer to the magazine tube.

19. The method of claim 11 further comprising, configuring a rear face section of the magazine tube to be uncovered by the at least one overmolded polymer section.

20. The method of claim 11 further comprising, forming the magazine tube from stainless steel.

* * * * *